United States Patent [19]

Fregeolle

[11] 3,975,929

[45] Aug. 24, 1976

[54] THIGH LENGTH ANTI-EMBOLISM STOCKING AND METHOD OF KNITTING SAME

[75] Inventor: Oscar Fregeolle, Hickory, N.C.

[73] Assignee: Alba-Waldensian, Incorporated, Valdese, N.C.

[22] Filed: Mar. 12, 1975

[21] Appl. No.: 557,603

[52] U.S. Cl. ..... 66/172 E; 128/165; 2/239; 66/178 A

[51] Int. Cl.[2] ..... D04B 9/46

[58] Field of Search ..... 66/178 R, 178 A, 172 E, 66/173 R, 175, 176, 177, 171; 2/239, 237, 240, 224 R, 224 A; 128/165, 519, 525, 539

[56] References Cited

UNITED STATES PATENTS

| | | | |
|---|---|---|---|
| 767,381 | 8/1904 | Brown | 66/178 R |
| 1,806,492 | 5/1931 | Nestler | 66/173 |
| 1,823,296 | 9/1931 | Seker | 2/237 |
| 1,860,272 | 5/1932 | Aberle | 66/172 E |
| 1,890,299 | 12/1932 | Mutchler | 66/178 A |
| 2,118,102 | 5/1938 | O'Connor | 66/173 |
| 2,190,409 | 3/1927 | Maier | 66/178 R X |
| 2,220,803 | 11/1940 | Lesher | 66/172 E |
| 2,357,506 | 9/1944 | Davis | 66/172 E X |
| 2,623,374 | 12/1952 | Hinchman | 66/171 X |
| 2,702,998 | 3/1955 | Purcell | 66/172 E X |
| 2,717,388 | 9/1955 | Rutledge | 66/177 UX |
| 3,098,368 | 7/1963 | Miles | 66/173 X |
| 3,130,566 | 4/1964 | Chesegro | 66/171 |
| 3,131,556 | 5/1964 | Nebel | 66/178 R X |
| 3,212,299 | 10/1965 | Frederick | 66/178 R |
| 3,274,804 | 9/1966 | Thorneburg et al. | 66/171 |
| 3,287,938 | 11/1966 | Knohl | 66/177 X |
| 3,289,329 | 12/1966 | Weiss | 66/171 X |
| 3,319,440 | 5/1967 | Nebel et al. | 66/178 R X |
| 3,457,737 | 7/1969 | Millar | 66/178 R |
| 3,516,266 | 6/1970 | Heggle | 66/172 R X |
| 3,728,875 | 4/1973 | Hartigan et al. | 66/178 A X |
| 3,729,956 | 5/1973 | Nebel et al. | 66/172 E |

FOREIGN PATENTS OR APPLICATIONS

| | | | |
|---|---|---|---|
| 226,539 | 1/1960 | Australia | 66/173 |
| 2,076,342 | 10/1971 | France | 66/172 E |
| 456,582 | 8/1913 | France | 2/240 |
| 688,311 | 3/1965 | Italy | 66/178 |
| 6,702,591 | 4/1967 | Netherlands | 66/178 A |
| 210,320 | 5/1968 | U.S.S.R. | 66/172 E |
| 1,233,415 | 5/1971 | United Kingdom | 2/239 |
| 1,126,677 | 9/1968 | United Kingdom | 66/178 A |

*Primary Examiner*—Mervin Stein
*Assistant Examiner*—Andrew M. Falik
*Attorney, Agent, or Firm*—Bell, Seltzer, Park & Gibson

[57] ABSTRACT

This stocking is knit on a circular hosiery knitting machine and the upper end of the leg is provided with an upstanding and integrally knit extension with a narrow elastic band extending around the remaining portion of the upper end of the leg portion. Opposite ends of the elastic band are attached to opposite sides of the extension. The upper section of the leg portion, immediately below the band and the extension, is knit with alternate courses of covered spandex yarn and intervening courses of stretchable textured yarn. The spandex yarn and stretchable yarn are both alternately knit and tucked to provide a circumferentially enlarged area in this upper portion of the leg of the stocking.

11 Claims, 5 Drawing Figures

THIGH LENGTH ANTI-EMBOLISM STOCKING AND METHOD OF KNITTING SAME

This invention relates generally to a thigh length anti-embolism stocking and to a method of knitting the same and more particularly to such a stocking which provides a gradually decreasing compressive force on the leg of the wearer from the ankle upwardly to the top of the stocking.

It has been found that elastic stockings reduce the incidence of pulmonary embolism in patients confined to bed and these stockings are routinely prescribed for many obstetric, medical, and surgical patients soon after they are admitted into the hospital. These stockings aid in speeding the blood flow and reduce the blood clotting conditions in the legs, where a great percentage of venous obstructions occur.

One type of anti-embolism stocking which has been widely used is disclosed in U.S. Pat. No. 3,728,875. This stocking is knit on a circular hosiery knitting machine and the upper portion is slit downwardly in a walewise direction and a wedge shaped insert of soft elastic fabric is sewn into the slit to increase the circumference of the upper end of the stocking. However, the slitting of the stocking and the sewing of the wedge shaped insert in the slit increases the cost of producing this type of stocking. The insert is not formed of the same type of compressive fabric as the remaining portion of the upper end of the stocking so that the portion of the leg covered by the insert does not receive the same compressive force as applied to the remaining portion of the leg of the wearer.

With the foregoing in mind, it is an object of the present invention to provide a thigh length anti-embolism stocking and method of knitting the same which requires no slitting of the stocking and does not require the sewing of a wedge shaped insert in the upper leg portion. The present stocking provides uniform compressive force around the area of the leg covered by the upper end of the stocking.

In accordance with the present invention, the upper end of the stocking is provided with an upstanding and integrally knit extension. The extension is formed in a manner similar to a turned welt with inner and outer plies and extends around the rear half of the top of the stocking. A narrow elastic band, having beads of frictional material on the inner surface thereof, extends around the remaining portion of the upper end of the leg of the stocking and from one side of the extension to the other. Opposite ends of the elastic band are secured to opposite sides of the extension and the lower edge of the elastic band is secured to the upper edge of the leg of the stocking with the upper edge of the elastic band being aligned with the upper edge of the integrally knit extension. The upper section of the leg, that section immediately below the elastic band and the upstanding extension, is knit with a special stitch construction so that this upper section may be knit larger than the lower portion of the leg and may be knit large enough that it is not necessary to enlarge the upper end of the stocking by means of a wedge shaped insert therein.

This upper section of the leg portion is knit with alternate courses of covered spandex yarn and intervening courses of stretchable textured yarn. The spandex yarn is tucked in the even wales and is knit in the odd wales of every other one of the alternate courses and the spandex yarn is knit in the even wales and tucked in the odd wales of the remaining of the alternate courses. The stretchable textured yarn is tucked in the even wales and knit in the odd wales of every other of the intervening courses and the stretchable textured yarn is knit in the even wales and is tucked in the odd wales of the remaining of the intervening courses. This knit construction permits large loops to be drawn of the textured stretchable yarn and permits the knitting of a larger circumference of fabric on the machine than would be possible if plain jersey stitches were knit in every course.

Other objects and advantages will appear as the description proceeds when taken in connection with the accompanying drawings, in which FIG. 1 is an isometric view of the stocking blank illustrating the manner in which the integrally knit extension stands up above the level of the upper end of the leg of the stocking;

Figure 1:
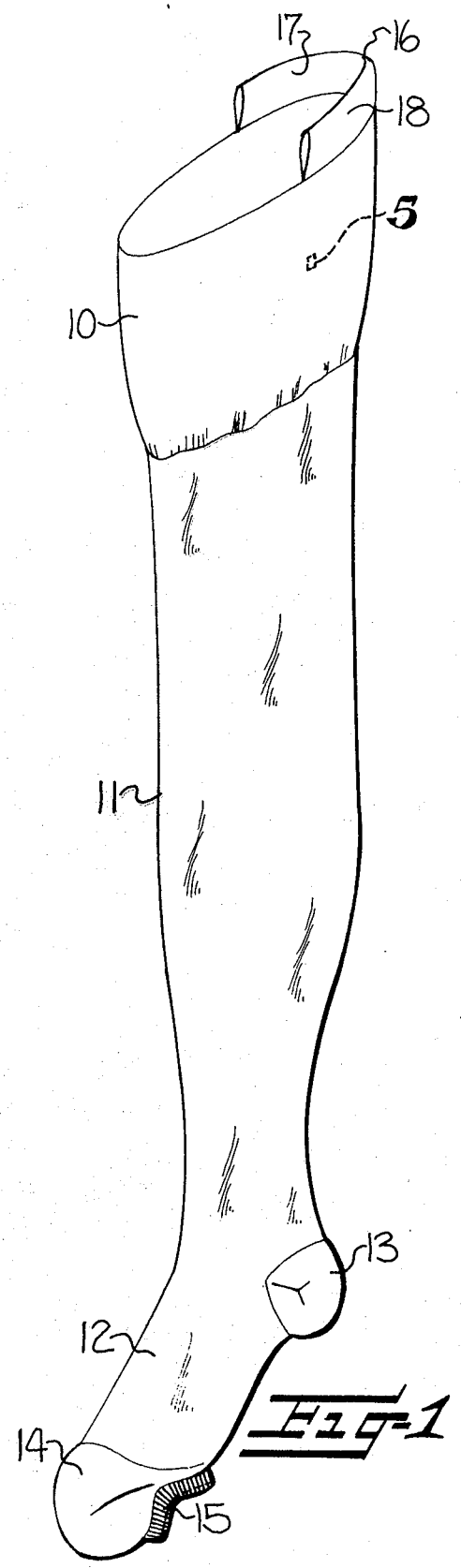
Figure 2:
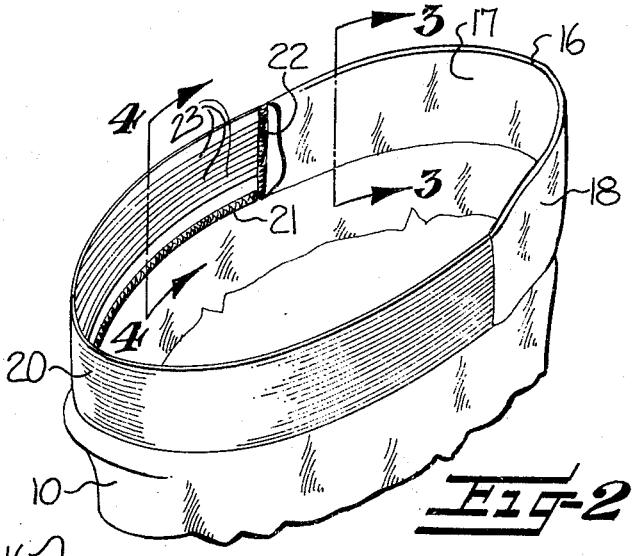
FIG. 2 is a fragmentary isometric view of the upper end of the stocking of the present invention with the elastic band being connected to the upper edge of the leg of the stocking and to opposite sides of the extension.
Figure 3:
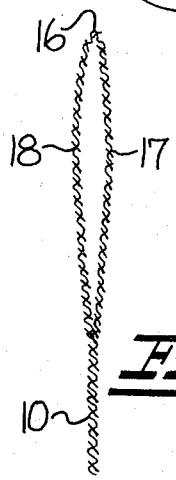
FIG. 3 is an enlarged vertical sectional view taken substantially along the lines 3—3 in FIG. 2 and illustrating the inner and outer plies of the turned welt extension.
Figure 4:
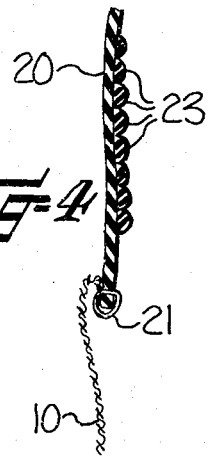
Figure 5:
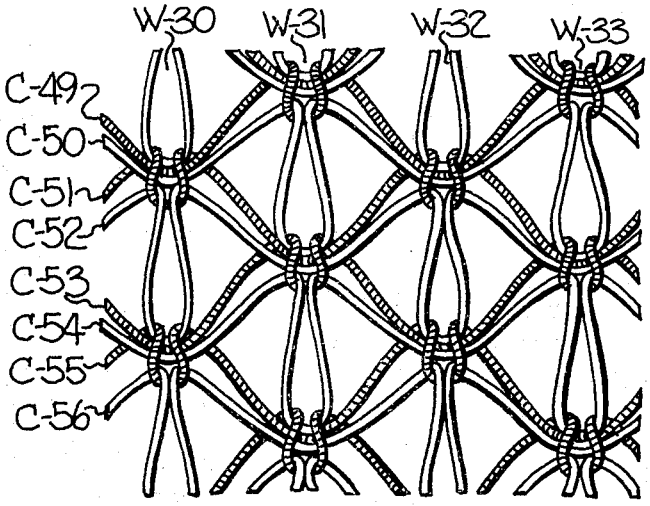

FIG. 4 is an enlarged vertical sectional view taken along the line 4—4 in FIG. 2 and showing the manner in which the elastic band is connected along its lower edge to the upper edge of the stocking leg; and FIG. 5 is a greatly enlarged view of a fragmentary portion of the fabric in the upper section of a leg portion, being taken in the area of the rectangle 5 in FIG. 1, and with the fabric stretched to the maximum amount possible in both the walewise and coursewise directions.

As shown in FIG. 1, the present stocking includes a leg portion having an enlarged upper section 10 and a lower leg portion 11 with a foot 12 including a heel pocket 13 and a toe pocket 14. If desired, the lower portion of the toe may be provided with a toe inspection opening 15. The upper end of the leg of the stocking is provided with an upstanding and integrally knit extension 16 which extends substantially one-half the distance around the upper end of the stocking and is formed of partial courses. The extension 16 is preferably knit in generally the same manner as a turned welt except that the extension is knit of partial courses formed with reciprocation of the needle cylinder. The extension 16 includes inner and outer plies 17, 18 which are joined at their lower ends and integrally knit with the upper edge of the enlarged section 10 at the upper end of the leg of the stocking.

A narrow elastic band 20 extends around the remaining portion of the upper end of the leg of the stocking and from one side of the extension 16 to the other. The elastic band is preferably of the same width as the height of the integrally knit extension 16 with the upper edge of the elastic band 20 being aligned with the upper edge of the integrally knit extension 16. The lower edge of the elastic band 20 is attached, as by a row of overedge stitching 21, to the upper edge of the stocking leg and opposite ends of the elastic band 20 are secured, as by rows of overedge stitching 22, to opposite ends of the extension 16, and preferably to the selvage edges at opposite ends of only the outer ply 18 of the turned welt extension 16. The inner face of the elastic band 20 is preferably provided with beads 23 or rows of frictional gripping material. These beads 23 of frictional material are formed of a foamed elastomeric material which is extruded onto the elastic band 20. The beads 23 aid in supporting the upper end of the stocking on the leg of the wearer by frictionally engaging the leg.

The fragmentary view of the portion of the fabric in the upper section 10 of the leg of the stocking (FIG. 5) is illustrated as if the fabric were stretched to the maximum amount possible in both coursewise and walewise directions. When the fabric is slightly relaxed, the small stitch loops of the spandex yarn, the yarn which is striped in FIG. 5, straighten out and dissappear so that the stitches of the stretchable textured yarn appear to be directly connected together in a walewise direction. The stretchable textured yarn is illustrated without striping to clearly distinguish the two yarns in the knit fabric. To aid in describing the fabric of FIG. 5, the wales and courses have been numbered.

As shown in FIG. 5, alternate courses (the odd numbered courses C-49, C-51, C-53 and C-55) are knit of the covered spandex yarn while the intervening courses (even numbered courses C-50, C-52, C-54 and C-56) are knit of stretchable textured yarn. The spandex yarn is tucked in the even wales (wales W-30 and W-32) and is knit in the odd wales (wales W-31 and W-33) of every other of the alternate courses (courses C-49 and C-53). The spandex yarn is knit in the even wales (wales W-30 and W-32) and is tucked in the odd wales (wales W-31 and W-33) of the remaining of the alternate courses (courses C-51 and C-55).

The stretchable textured yarn is tucked in the even wales (wales W-30 and W-32) and is knit in the odd wales (wales W-31 and W-33) of every other of the intervening courses (courses C-50 and C-54). The stretchable textured yarn is knit in the even wales (wales W-30 and W-32) and is tucked in the odd wales (wales W-31 and W-33) in the remaining of the intervening courses (courses C-52 and C-56). With this stitch construction, each wale of the fabric includes alternating stitch loops of spandex yarn and stretchable textured yarn and the stitch loops are staggered from one wale to the next.

The lower leg section 11 of the leg of the stocking may be knit of any suitable stitch construction which provides a graduated compressive force on the leg of the wearer. The lower leg section 11 is preferably knit of a covered spandex yarn and a stretchable textured yarn with the stretchable textured yarn being knit in every wale of alternate courses and the spandex yarn being knit in every other wale and floated across single wales in the intervening courses. It is preferred that the floats of the covered spandex yarn be staggered walewise from one course to the next. The knitting of this type of fabric is disclosed in detail in York et al U.S. Pat. No. 3,250,092. However, it is to be understood that other types of stitch construction may be knit in the lower leg section 11 of the stocking.

This type of stitch construction preferably extends through the rotary knit portions of the foot 12 and the heel and toe pockets 13, 14 may be knit with plain jersey stitches in the conventional manner. Although various sizes and types of yarns may be utilized, it has been found that a satisfactory anti-embolism stocking can be knit by knitting alternate courses in both the upper section 10 and the lower section 11 of 184 denier spandex yarn covered with two ends of 20 denier nylon. The intervening courses in the upper section 10 are knit of two ends of 20 denier textured nylon. The intervening courses of the lower leg section 11 and foot 12 are knit of two ends of 30 denier textured nylon. All the partial courses in the upper turned welt 16 are knit of two ends of 20 denier textured nylon.

METHOD OF KNITTING

The knitting of the stocking blank of the present invention will be described as if it is knit on a 400 needle circular hosiery knitting machine having two yarn feeding and knitting stations and including a dial having the usual component of radially slideable transfer points supported therein. However, it is to be understood that the stocking blank of the present invention could be knit on other types of circular hosiery knitting machines having a different number of needles and having a greater or lesser number of yarn feeding and knitting stations. To begin knitting, the usual make-up is formed by feeding the stretchable textured yarn to every other needle and moving substantially half of the transfer points outwardly over those needles which knit the rear half of the stocking, that half of the stocking containing the heel pocket 13. The yarn is picked up and loops are held on the transfer points and are held thereon until knitting of the extension 16 is completed. A few complete courses may then be knit to form a small selvage edge along the upper end of the leg and opposite the extension 16.

The extension 16 is then knit by reciprocating the needle cylinder and knitting successive partial courses of the same length on substantially half of the needles with each swing of the needle cylinder in both directions to form both the inner and outer plies 17, 18 with straight selvage edges thereon. When the proper number of partial courses have been knit to form the turned welt, the transfer points are moved outwardly so that the held stitch loops at the lower edge of the inner ply 17 are transferred back to the cylinder needles to complete the turned welt extension 16. The needle cylinder is then rotated and all needles knit to form complete courses in the upper section 10 of the leg of the stocking.

To knit the upper section 10, the covered spandex yarn is fed at one station and the covered spandex yarn is tucked on the even needles, as illustrated in wales W-30 and W-32 of course C-49 (FIG. 5) while the spandex yarn is knit on the odd needles, as illustrated in wales W-31 and W-32 of course C-49. At the other knitting station, the stretchable textured yarn is also tucked on the even needles, as illustrated in wales W-30 and W-32 of course C-50 while this yarn is knit on the odd needles, as illustrated in wales W-31 and W-33 of course C-50. During the next rotation of the needle cylinder, the spandex yarn is knit on the even needles, as illustrated in wales W-30 and W-32 of course C-51, and is tucked on the odd needles, as illustrated in wales W-31 and W-33 of course C-51. During the next rotation of the needle cylinder, the stretchable textured yarn is knit on the even needles, as illustrated in wales W-30 and W-32 of course C-52, and is tucked on the odd needles, as illustrated in wales W-31 and W-33 of course C-52. This knitting sequence continues until the desired length is formed in the upper section 10 of the leg of the stocking.

During the knitting of the upper section 10, the stitch length adjustment of the machine is adjusted to knit the maximum length of stitch. The length of stitch being knit can be greater than that which can normally be knit on this type of machine. The special stitch construction illustrated in FIG. 5 permits larger stitches to be formed because the small tight stitches of spandex yarn aid in operating the needle latches during knitting. It is preferred that the top section 10 be approximately five inches in length and have a circumference of approximately thirteen inches, when in relaxed condition.

The lower section 11 of the leg of the stocking is then knit by continuing to feed the spandex yarn at one station while feeding the stretchable textured yarn at the other station. The stretchable textured yarn is knit on every needle while the spandex yarn is alternately knit and floated with the floats of the spandex yarn being staggered from one spandex course to the next. As the knitting of the lower section of the leg 11 continues, it is preferred that the stitch size be gradually reduced, in a conventional manner down to the ankle of the stocking. The circumference of upper end of the lower leg section 11 is about nine inches and the circumference of the ankle is about six and one-half inches when the stocking blank is relaxed. The heel and toe pockets may be knit in a conventional manner and any suitable type of toe inspection opening, such as that illustrated at 15 in FIG. 1, may be provided at the lower end of the stocking.

Upon completion of the knitting of the stocking, the elastic band 20 is then attached to the upper end of the stocking, in the manner heretofore described, and the stocking is completed. The stocking may be boarded in the usual manner. Thus, the present stocking is completed on the knitting machine except for attaching the elastic band 20 to the upper end of the upper section 11 and to opposite ends of the extension 16. The present stocking eliminates the need for slitting the stocking in a walewise direction downwardly from the upper end and sewing in an insert in this portion of the stocking. By knitting the extension 16 around the rear portion of the stocking, the elastic band 20 extends across the front portion of the leg of the wearer and the beads 23 of frictional material engage the front portion of the leg. This arrangement provides better support for the upper end of the stocking when the leg bends at the knee than the support provided if the beads 20 of frictional material and the elastic band 20 extended around the rear portion of the leg.

In the drawings and specification, there has been set forth a preferred embodiment of the invention, and although specific terms are employed, they are used in a generic and descriptive sense only and not for purposes of limitation.

That which is claimed is:

1. A thigh length anti-embolism elastic stocking including a foot portion and a leg portion including complete courses, an extension integrally knit with a portion of the uppermost complete course at the upper end of said leg portion and extending upwardly therefrom, said extension being formed of partial courses and including an upper edge at a higher level than the remaining portion of the upper end of said leg portion, a narrow elastic band extending around the remaining portion of the upper end of said leg portion and from one side of said extension to the other, said elastic band including opposite ends, seam means connecting said opposite ends of said elastic band to opposite sides of said extension, said elastic band including upper and lower edges, and seam means connecting said lower edge of said elastic band to the remaining portion of the uppermost complete course at the upper end of said leg so that said elastic band extends upwardly above the upper end of said leg and with said upper edge of said elastic band being aligned with the upper edge of said integrally knit extension.

2. A stocking according to claim 1 wherein said extension is positioned at the rear of said stocking.

3. A stocking according to claim 1 wherein said extension encompasses substantially one-half the distance around the top of said stocking.

4. A stocking according to claim 1 wherein said extension comprises a turned welt.

5. A stocking according to claim 4 wherein said turned welt extension includes inner and outer plies and wherein opposite end portions of said elastic band are secured to the outer ply only of said turned welt extension.

6. A thigh length anti-embolism elastic stocking according to claim 1 wherein at least the upper section of said leg portion comprises alternate courses knit of covered spandex yarn and intervening courses knit of stretchable textured yarn, said spandex yarn being tucked in the even wales and being knit in the odd wales of very other of said alternate courses, said spandex yarn being knit in the even wales and being tucked in the odd wales of the remaining of said alternate courses, said stretchable textured yarn being tucked in the even wales and being knit in the odd wales of every other of said intervening courses, said stretchable textured yarn being knit in the even wales and being tucked in the odd wales of the remaining of said intervening courses.

7. A method of forming a thigh length anti-embolism elastic stocking comprising the steps of knitting a stocking blank on a circular hosiery knitting machine by reciprocatorily knitting an extension on substantially half of the needles in the knitting machine, thereafter rotary knitting on all of the needles of the machine to form successive complete courses in the upper portion of the leg of the stocking, and knitting the remaining portion of the leg and foot of the stocking, and

8. A method according to claim 7 including the step of forming said extension by knitting a turned welt having inner and outer plies.

9. A method according to claim 8 including the step of stitching the ends of said elastic band to only the outer ply of said turned welt extension.

10. A method according to claim 7 wherein the needles on which said extension is knit are the needles which knit the rear portion of the leg of said stocking.

11. A method according to claim 7 including the steps of knitting alternate courses of said upper portion of the leg of the stocking of covered spandex yarn, and knitting intervening courses of stretchable textured yarn, tucking said spandex yarn in the even wales and knitting the spandex yarn in the odd wales of every other of said alternate courses, knitting the spandex yarn in the even wales and tucking the spandex yarn in the odd wales of the remaining of said alternate courses, tucking the stretchable textured yarn in the even wales and knitting the stretchable textured yarn in the odd wales of every other of said intervening courses, and knitting the stretchable textured yarn in the even wales and tucking the stretchable textured yarn in the odd wales of the remaining of said intervening courses.

* * * * *

UNITED STATES PATENT OFFICE

CERTIFICATE OF CORRECTION

PATENT NO. : 3,975,929

DATED : August 24, 1976

INVENTOR(S) : Oscar Fregeolle

It is certified that error appears in the above-identified patent and that said Letters Patent are hereby corrected as shown below:

Column 6, line 23, change "very" to -- every --;

Column 6, line 42, following "and" insert -- then attaching an elastic band to the uppermost courses of the stocking leg by stitching endmost portions of said elastic band to opposite sides of said reciprocatorily knit extension and stitching the lower edge of said elastic band to the uppermost courses of the upper portion of the leg of the stocking --.

Signed and Sealed this

Second Day of November 1976

[SEAL]

*Attest:*

RUTH C. MASON
*Attesting Officer*

C. MARSHALL DANN
*Commissioner of Patents and Trademarks*